US011425981B1

(12) United States Patent
Vasquez et al.

(10) Patent No.: US 11,425,981 B1
(45) Date of Patent: Aug. 30, 2022

(54) MANICURIST RESTING STATION

(71) Applicants: Ramona Vasquez, Ruskin, FL (US); Valentin Vasquez, Ruskin, FL (US)

(72) Inventors: Ramona Vasquez, Ruskin, FL (US); Valentin Vasquez, Ruskin, FL (US)

( * ) Notice: Subject to any disclaimer, the term of this patent is extended or adjusted under 35 U.S.C. 154(b) by 11 days.

(21) Appl. No.: 17/193,780

(22) Filed: Mar. 5, 2021

(51) Int. Cl.

| | |
|---|---|
| ***A45D 29/00*** | (2006.01) |
| ***F21V 21/32*** | (2006.01) |
| ***F21V 27/02*** | (2006.01) |
| ***F21V 23/04*** | (2006.01) |

(52) U.S. Cl.
CPC ..... *A45D 29/00* (2013.01); *F21V 21/32* (2013.01); *F21V 23/04* (2013.01); *F21V 27/02* (2013.01); *A45D 2200/15* (2013.01)

(58) Field of Classification Search
CPC ..... A45D 29/00; A45D 29/18; A45D 29/22; A45D 2200/15; F21V 21/32
See application file for complete search history.

(56) References Cited

U.S. PATENT DOCUMENTS

| | | | | |
|---|---|---|---|---|
| 2,374,472 A * | 4/1945 | Joseph | ..... | A45D 29/18 34/239 |
| 5,139,036 A * | 8/1992 | Pickard | ..... | A45D 29/00 132/75 |
| 2020/0022476 A1* | 1/2020 | Gregory | ..... | F21V 1/00 |

* cited by examiner

*Primary Examiner* — Mariceli Santiago
(74) *Attorney, Agent, or Firm* — Lyman H. Moulton, Esq.; Moulton Patents, PLLC

(57) ABSTRACT

The disclosure, aka Magic Hands in the only manicure procedure device developed specifically to facilitate a quality beauty treatment for clients and the manicurist. The Magic Hands is uniquely designed to offer a hand rest that will provide comfort and simplify the manicure process as well as come in an array of colors. The manicure station as disclosed includes a hand rest configured in the shape of a curved horn and having a solid matte base, a self contained power source and control buttons thereon. The disclosure also includes a flexible neck lamp connected to the hand rest via a cord for power and for control. The disclosure further includes an ergonomic heating pad attached to the hand rest and configured to draw power therefrom.

20 Claims, 1 Drawing Sheet

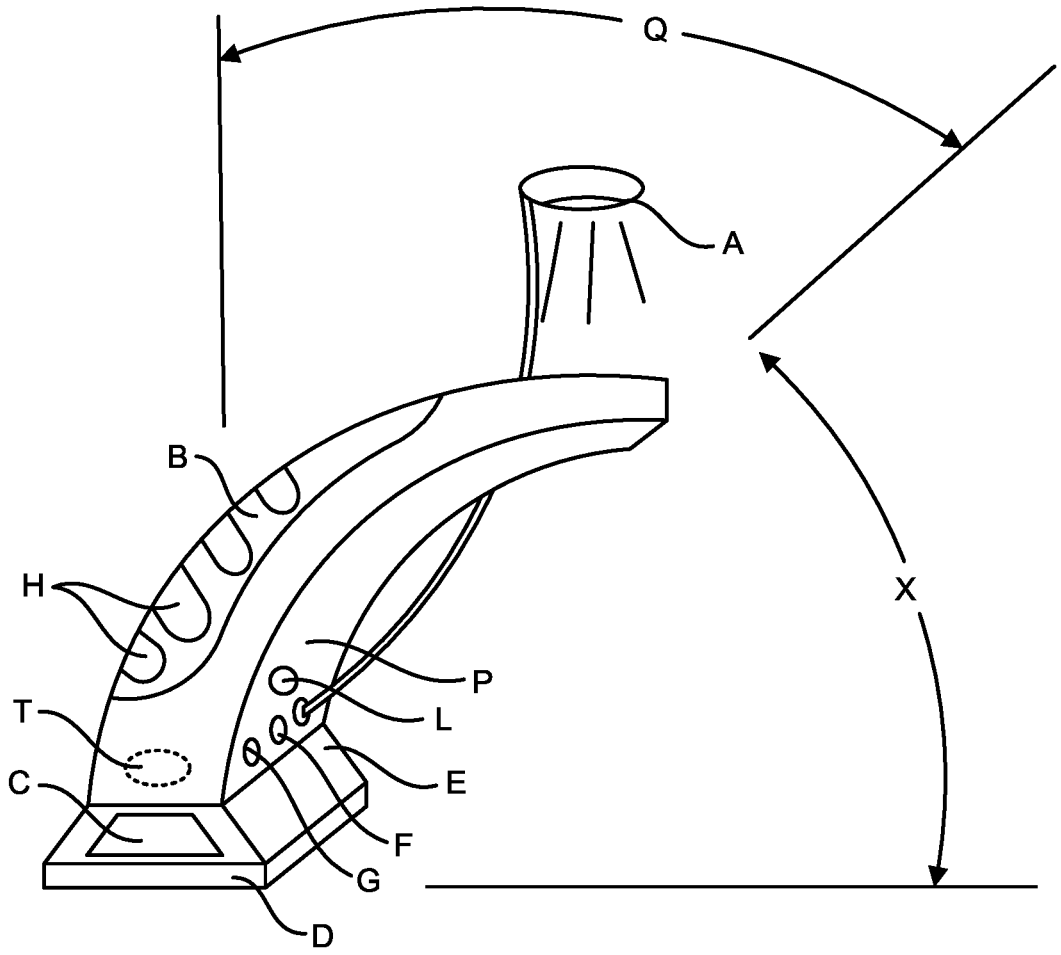
Q
A
B
H
X
P
L
T
E
C
F
G
D

MANICURIST RESTING STATION

BACKGROUND

Receiving manicures is an essential procedure utilized to maintain personal hygiene and enhance physical appearance. However, during the beautifying process persons involved (the manicurist and customer) tend to be in an uncomfortable hand position to properly obtain a quality manicure. This often creates an unpleasant experience as well as causes joint pain for the customer. There have been no products available as original equipment or as an aftermarket to address this problem.

An apparatus to simplify the process of getting manicures is needed in the present market. Furthermore, a device to help the manicurist and the customer be more comfortable with the hand positions when obtaining the manicure can relieving pain in the joints. There have been no products available as original equipment or as an aftermarket to address these problems either.

There exists a need for an apparatus or device that is not being met by any known or disclosed device or system of present which enables a pleasant manicure for both the client and the manicurist.

SUMMARY OF THE INVENTION

The main purpose of the disclosure, also known as Magic Hands, hereion is to provide a methodical approach to performing manicures, specifically to contribute to relaxation for the nail technician and nail client. A manicure station as disclosed includes a hand rest configured in the shape of a curved horn and having a solid matte base, a self contained power source and control buttons thereon. The disclosure also includes a flexible neck lamp connected to the hand rest via a cord for power and for control. The disclosure further includes an ergonomic heating pad attached to the hand rest and configured to draw power therefrom.

BRIEF DESCRIPTION OF THE DRAWINGS

FIG. 1. This is a perspective view of the Magic Hands apparatus in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1. This is a perspective view of the Magic Hands apparatus in accordance with an embodiment of the present disclosure. The view shows: A. Battery operated flexible neck lamp, B. Flexible heating pad (optional), C. Battery compartment, D. Solid mat base, E. One piece hand rest comes in different colors, F. heat lower button, and G heat raise in accordance with an embodiment of the present disclosure. The view also shows the molded fingers H in the ergonomic heating pad B, The palm rest P, the thermostat T and the lamp switch L. The view also includes the angle sigma from a horizontal reference and the angle theta from a vertical reference from a base of the curve shaped horn to a tip thereof.

The Magic Hands is an apparatus that supplies a resting station for a person's hand during the process of acquiring a manicure. The Magic Hands is constructed of a lightweight durable plastic material with the dimensions: 3 to 4½ inches tall, 8 to 9 inches in length, and 4½ to 6 inches wide while operating on batteries to function the device. Additionally, the instrument will include a batter-operated flexible neck lamp while the battery compartment is placed on the bottom side of the tool. This allows the manicurist to adjust the lighting to physically examine the customer's nails to accurately perform the beauty treatment. For additional features, the tool will have a flexible heating pad to supply a relaxing sensation on the client's hand, but this is an optional feature depending on the preference of the client. The Magic Hands will also possess a one-piece hand rest that comes in many colors to provide a restful location for the customer's hand while painting, cleaning, and/or filing fingernails as well as apply acrylic, This feature contributes to the relaxation on the client and the nail tech's hand position while alleviating any discomfort that may occur. Furthermore, the device will have a lamp switch and heating switch to activate, or deactivate, the lighting and heating features of the tool. This tool will help nail technicians who seek to minimize the level of stiffness that can take place when performing a manicure service.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A manicure station comprising:

a hand rest configured in the shape of a curved horn and having a solid matte base, a self contained power source and control buttons thereon;

a flexible neck lamp connected to the hand rest via a cord for power and for control; and an ergonomic heating pad attached to the hand rest and configured to draw power therefrom.

2. The manicure station of claim 1, wherein the self contained power source is a direct current battery received in a battery compartment thereof.

3. The manicure station of claim 1, wherein the solid matte base base is a high durometer and metallic composite.

4. The manicure station of claim 1, wherein the solid matte base is magnetic.

5. The manicure station of claim 1, wherein the solid matte base flares out from the hand rest and therefore puts a center of gravity inside the hand rest so that it stands upright.

6. The manicure station of claim 1, wherein the hand rest and the ergonomic heating pad are molding into a single unit with the ergonomic heating pad on a top side of a curve of the curved horn shape.

7. The manicure station of claim 1, wherein the hand rest comprises a control button for the flexible neck lamp.

8. The manicure station of claim 1, wherein the hand rest comprises a control button for the ergonomic heating pad.

9. The manicure station of claim 1, wherein the hand rest comprises a releasable power cord receptacle for the cord of the flexible neck lamp.

10. The manicure station of claim 1, wherein the hand reset further comprises a universal serial bus (USB) connection for auxiliary hookups thereto.

11. The manicure station of claim 1, wherein the ergonomic heating pad includes finger moldings to be grasped from a user's palm against an underside of the curved horn shape.

12. The manicure station of claim 1, wherein a palm of the user is disposed immediately adjacent an underside of the curved horn shape so the user's fingernails are exposed on an upperside of the curved horn shape for service.

13. The manicure station of claim 1, further comprising a thermostat in the hand rest configured to maintain a constant predetermined temperature in the hand rest.

14. The manicure station of claim 1, wherein the hand rest further comprises a raise heat button for the ergonomic heating pad which raises the temperature thereof in half degree increments.

15. The manicure station of claim 1, wherein the hand rest further comprises a lower heat button for the ergonomic heating pad which lowers the temperature thereof in half degree decrements.

16. The manicure station of claim 1, further comprising a hand shaking protocol circuitry in the hand rest configured to coordinate a common temperature in the ergonomic heat pad with a second ergonomic heat pad of a second hand rest.

17. The manicure station of claim 1, wherein the hand rest measures a nominal 4½ inches tall.

18. The manicure station of claim 1, wherein the hand rest measures a nominal 8 to 9 inches in length from the matte base to a tip of the curved horn shape.

19. The manicure station of claim 1, wherein the hand rest measures a nominal 6 inches wide at the matte base to 4½ inches wide at the base of the curved horn shape.

20. The manicure station of claim 1, wherein a curve of the curve horn shape is 45 degrees from a horizontal reference and 45 degrees from a vertical reference from a base of the curve horn shape to a tip thereof.

* * * * *